US007846046B2

(12) United States Patent
Greenberg et al.

(10) Patent No.: US 7,846,046 B2
(45) Date of Patent: Dec. 7, 2010

(54) SYSTEM AND METHOD OF PREPARING A PLAYING SURFACE

(75) Inventors: Mark E. Greenberg, Lexington, MA (US); Moise Roditi, Lexington, MA (US)

(73) Assignee: Hawk-Eye Sensors Limited

( * ) Notice: Subject to any disclaimer, the term of this patent is extended or adjusted under 35 U.S.C. 154(b) by 306 days.

(21) Appl. No.: 12/035,825

(22) Filed: Feb. 22, 2008

(65) Prior Publication Data

US 2008/0220912 A1 Sep. 11, 2008

Related U.S. Application Data

(60) Provisional application No. 60/903,084, filed on Feb. 23, 2007.

(51) Int. Cl.
*A63B 71/06* (2006.01)
*A63B 61/00* (2006.01)

(52) U.S. Cl. ..... 473/467; 473/415; 473/490

(58) Field of Classification Search ..... 473/467, 473/415, 490; 239/754; 404/12, 84.05; 427/8; 472/92

See application file for complete search history.

(56) References Cited

U.S. PATENT DOCUMENTS

| | | | |
|---|---|---|---|
| 2,787,784 | A | 4/1957 | Meryman et al. |
| 3,695,222 | A | 10/1972 | Arrant |
| 3,774,194 | A | 11/1973 | Jokay et al. |
| 4,090,708 | A | 5/1978 | McPeak |
| 4,345,544 | A | 8/1982 | Besecker |
| 4,365,805 | A | 12/1982 | Levine |
| 4,575,943 | A | 3/1986 | Baum, Jr. |
| 4,664,376 | A | 5/1987 | Gray |
| 4,682,910 | A | 7/1987 | Hollon et al. |
| 4,718,670 | A | 1/1988 | Gray |
| 4,814,986 | A | 3/1989 | Spielman |
| 4,840,377 | A | 6/1989 | Bowser et al. |
| 4,855,711 | A | 8/1989 | Harrop et al. |

(Continued)

FOREIGN PATENT DOCUMENTS

| | | | |
|---|---|---|---|
| DE | 3835133 | A1 | 4/1990 |

(Continued)

OTHER PUBLICATIONS

Webpage download, axyz,2005, http://web.archive.org/web/20050305035704/www.axyz.com/table_4000.html, 2 pages.*

(Continued)

*Primary Examiner*—Gene Kim
*Assistant Examiner*—M Chambers
(74) *Attorney, Agent, or Firm*—Wolf, Greenfield & Sacks, P.C.

(57) ABSTRACT

A movable frame may be positioned about a playing surface and defines a substantially straight pathway for a tool to follow while altering a playing surface, such as by cutting or marking the surface. A template that may be used to accurately define key positions of a playing surface, like a tennis court. Various pairs of the key positions may, in turn, be used to define each line that is to be marked or altered on the playing surface. Patterns of sensor circuits are defined for indentifying whether a ball impacts the tennis court at a position that is in play, or out of play.

16 Claims, 8 Drawing Sheets

U.S. PATENT DOCUMENTS

| | | | | |
|---|---|---|---|---|
| 5,059,944 | A | | 10/1991 | Carmona |
| 5,082,263 | A | | 1/1992 | Berger |
| 5,107,595 | A | | 4/1992 | Stay et al. |
| 5,138,322 | A | | 8/1992 | Nuttall |
| 5,158,282 | A | | 10/1992 | Winter |
| 5,167,110 | A | * | 12/1992 | Reimer ..... 56/327.1 |
| 5,303,915 | A | | 4/1994 | Candy |
| 5,363,297 | A | | 11/1994 | Larson et al. |
| 5,394,824 | A | | 3/1995 | Johnson, Jr. |
| 5,446,635 | A | * | 8/1995 | Jehn ..... 362/259 |
| 5,478,393 | A | | 12/1995 | Vacanti |
| 5,486,067 | A | * | 1/1996 | Huynh et al. ..... 404/84.05 |
| 5,551,688 | A | | 9/1996 | Miller |
| 5,672,128 | A | | 9/1997 | Conn |
| 5,800,292 | A | | 9/1998 | Brace |
| 5,908,361 | A | | 6/1999 | Fisher et al. |
| 5,954,599 | A | | 9/1999 | Linn |
| 5,964,411 | A | | 10/1999 | McGuffie |
| 5,997,647 | A | | 12/1999 | McGuffie |
| 6,024,658 | A | | 2/2000 | Marshall |
| 6,035,757 | A | * | 3/2000 | Caluori et al. ..... 83/520 |
| 6,048,282 | A | | 4/2000 | Prevost et al. |
| 6,253,456 | B1 | | 7/2001 | Cooksey |
| 6,331,129 | B1 | | 12/2001 | Earley |
| 6,367,332 | B1 | | 4/2002 | Fisher et al. |
| 6,470,582 | B1 | | 10/2002 | Renko |
| 6,671,390 | B1 | | 12/2003 | Barbour et al. |
| 6,709,350 | B1 | | 3/2004 | Onstad |
| 6,751,880 | B1 | | 6/2004 | Amron et al. |
| 6,816,185 | B2 | | 11/2004 | Harmath |
| 6,831,603 | B2 | | 12/2004 | Menache |
| 6,941,818 | B2 | | 9/2005 | Rakowski |
| 7,005,970 | B2 | | 2/2006 | Hudsdon et al. |
| 7,137,207 | B2 | | 11/2006 | Armstrong et al. |
| 2002/0014015 | A1 | | 2/2002 | Robertson |

FOREIGN PATENT DOCUMENTS

| | | | |
|---|---|---|---|
| EP | 1178153 | A1 | 6/2002 |
| FR | 2498462 | A1 | 7/1982 |
| WO | WO9403243 | A1 | 2/1994 |
| WO | WO95/16827 | A1 | 6/1995 |
| WO | WO02/076562 | A1 | 10/2002 |

OTHER PUBLICATIONS

Blue Ripper Jr Rail Saw, www.blueripper.com, as taken from a link dated Feb. 12, 2007 on www.archive.org.

Invitation to Pay Additional Fees and Partial International Search, International Application No. PCT/US2008/002345.

International Search Report and Written Opinion, Application No. PCT/US2008/002345, mailed Nov. 17, 2008.

International Preliminary Report on Patentability, Application No. PCT/US2008/002345, mailed Sep. 3, 2009.

* cited by examiner

SYSTEM AND METHOD OF PREPARING A PLAYING SURFACE

This application claims priority under 35 U.S.C. §119(e) to U.S. Provisional Application Ser. No. 60/903,084, filed on Feb. 23, 2007, which is hereby incorporated by reference in its entirety.

BACKGROUND

1. Field

Aspects of the invention relate to marking or cutting a playing surface or positioning of sensors about a playing surface, and particularly to the playing surfaces of tennis courts.

2. Discussion of Related Art

Lines of a playing surface, like a tennis court, are marked most frequently by placing nails at corners of the playing surface and snapping a chalk line between the nails. A diagonal may be measured between diametrically opposed corners in efforts to confirm the proper placement of the nails and orientation of the chalk lines. Parallel pieces of masking tape are then placed around the chalk lines, such as with a line taper—a process that is very dependent on the skill of the operator. Once masked, clear paint is typically applied between the masking tape to fill any gaps between the tape and the playing surface to prevent any later applied opaque paint from entering these same gaps. An opaque paint, such as white, is then applied between the masking tape and the masking tape is removed. The applicant has appreciated that such methods often lead to poorly and inaccurately marked playing surfaces.

Sensors may be embedded in or placed on some playing surfaces to help track whether balls land in our out of bounds during play. Sensor materials placed on and near boundary lines of sports games, such as tennis, have been the subject of several patents, including U.S. Pat. No. 5,908,361 by Fisher, U.S. Pat. No. 6,941,818 by Rakowski, U.S. Pat. No. 5,394,824 by Johnson, U.S. Pat. No. 5,954,599 by Lucent, U.S. Pat. No. 5,672,128 by JAB Tech, and U.S. Pat. No. 4,840,377 by Bowser. The applicant has appreciated that in such systems, problems associated with inaccurately marked playing surfaces are often compounded, since mismatch between the visible markings and positions of the sensors may result in improper readings and/or a lack of confidence by players in the sensing system.

SUMMARY

One aspect of the invention relates to a system for modifying a playing surface. The system comprises a movable frame that extends for a distance of 3 feet or more to define a first substantially straight horizontal axis. A tool platform may move along the first horizontal axis and has a mounting feature for one or more tools that may be used for modifying the playing surface. The tool platform may also be mounted on a gantry. The gantry may define a second substantially straight horizontal axis, transverse to the first horizontal axis. The tool platform may also be configured to move along the second horizontal axis.

Another aspect of the invention relates to a template for identifying key positions on a tennis court. The template comprises a first set of strips of material for identifying key positions of the tennis court. The first set of strips includes five or more strips of material that, when placed on the tennis court, overlie at least two points that intersect each line to be marked on the tennis court. A second set of strips of material includes strips that connect two or more strips of the first set. The strips of the second set lie transverse to each strip of the first set, when connected to the two or more strips of the first set.

Another aspect of the invention relates to a pattern of sensor circuits for a tennis court that includes a baseline, a left and a right doubles side line, a left and a right singles side line, a service line, and a center service line. The pattern comprises seven circuits, as described below:

a first circuit positioned outside of each of the left and right doubles side lines and the baseline;

a second circuit positioned beneath a portion of the baseline, a portion of each of the left and right singles side lines, and outside of the service line;

a third circuit positioned beneath the left doubles side line, a portion of the baseline, and outside of the left singles side line;

a fourth circuit positioned beneath the right doubles side line, a portion of the baseline, and outside of the right singles side line;

a fifth circuit positioned under a portion of the left singles side line, a portion of the service line, and positioned left of the center service line;

a sixth circuit positioned under a portion of the right singles side line, a portion of the service line, and positioned right of the center service line; and a seventh circuit positioned under both sides of the center service line.

Yet another aspect of the invention relates to a pattern of sensor circuits for a tennis court that includes a baseline, a left and a right doubles side line, a left and a right singles side line, a service line, and a center service line. The pattern comprises five circuits, as described below:

a first circuit positioned beneath portions of the baseline and portions of each of the left and right singles side lines;

a second circuit positioned beneath a portion of the service line, a right portion of the center service line, and a portion of the left singles side line;

a third circuit positioned beneath a portion of the service line, a left portion of the center service line, and a portion of the right singles side line;

a fourth circuit positioned beneath the left doubles side line, and a portion of the baseline; and a fifth circuit positioned beneath the right doubles side line, and a portion of the baseline.

Yet another aspect of the invention relates to a method of altering a playing surface. The method comprises positioning a movable frame on a playing surface at a first position. The movable frame defines a first substantially horizontal axis along which the tool may travel. A cutting tool is attached to the movable frame and a groove is cut in the playing surface that lies parallel to the first horizontal axis. A marking tool is attached to the movable frame. The movable frame is moved to a second position, after cutting the groove, and is then repositioned at the the first position. A line is then marked that is in registration with the groove in the playing surface.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing.

Various embodiments of the invention will now be described, by way of example, with reference to the accompanying drawings, in which.

DETAILED DESCRIPTION

Aspects of the invention relate to a movable frame that may be positioned about a playing surface. The movable frame defines a substantially straight horizontal axis that a tool may follow to modify the playing surface. A second substantially straight horizontal axis transverse to the first horizontal axis allows the tool to be positioned onto paths spaced from one another and parallel to the first horizontal axis. In this respect, the tool may modify the playing surface along multiple parallel paths. Various different tools may be mounted to the movable platform to alter the playing surface in different ways, such as by marking or cutting the playing surface. According to some embodiments, the movable frame includes features that position a tool, like a saw, a controlled vertical distance from the playing surface, and in this respect, may accommodate any variation in topography of the playing surface to cut a groove to a controlled depth.

Aspects of the invention also relate to a template that may be used to accurately define key positions of a playing surface, like a tennis court. Various pairs of the key positions may, in turn, be used to define each line that is to be marked on the playing surface as well as the proper positioning of the movable frame before the playing surface is altered with a tool of the movable frame.

Aspects of the invention also relate to patterns of sensor circuits laid about a tennis court to indentify whether a ball impacts the tennis court at a position that is in play, or out of play. A first embodiment is optimized for supervised play, using fewer sensors. A second embodiment is configured for comprehensive coverage of a tennis court, and may prove particularly useful for play that is unsupervised by a referee.

Figure 1:
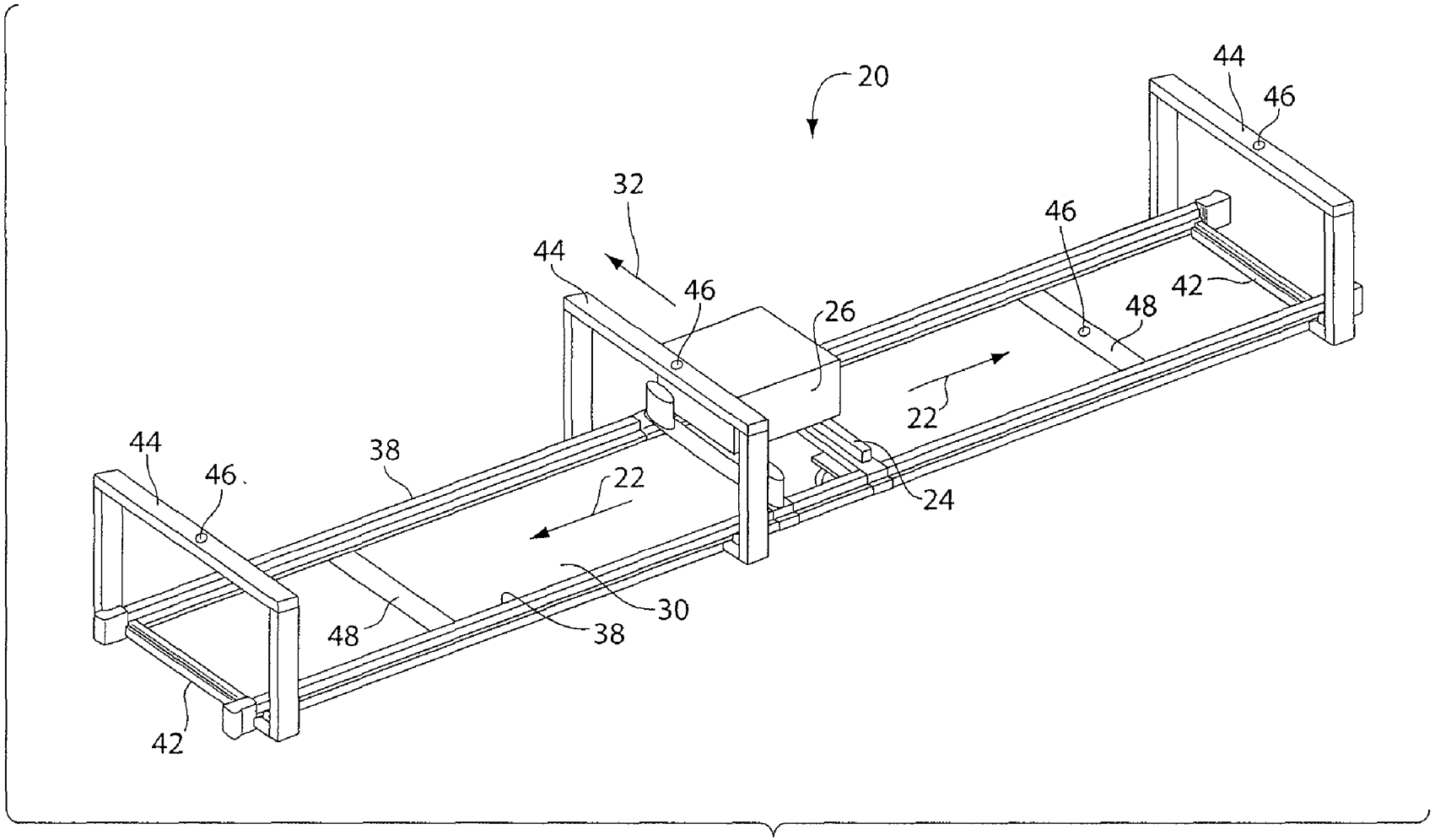
FIG. 1 is a perspective view of an embodiment of a movable frame that may be used to alter a playing surface, according to one embodiment.
Figure 2:
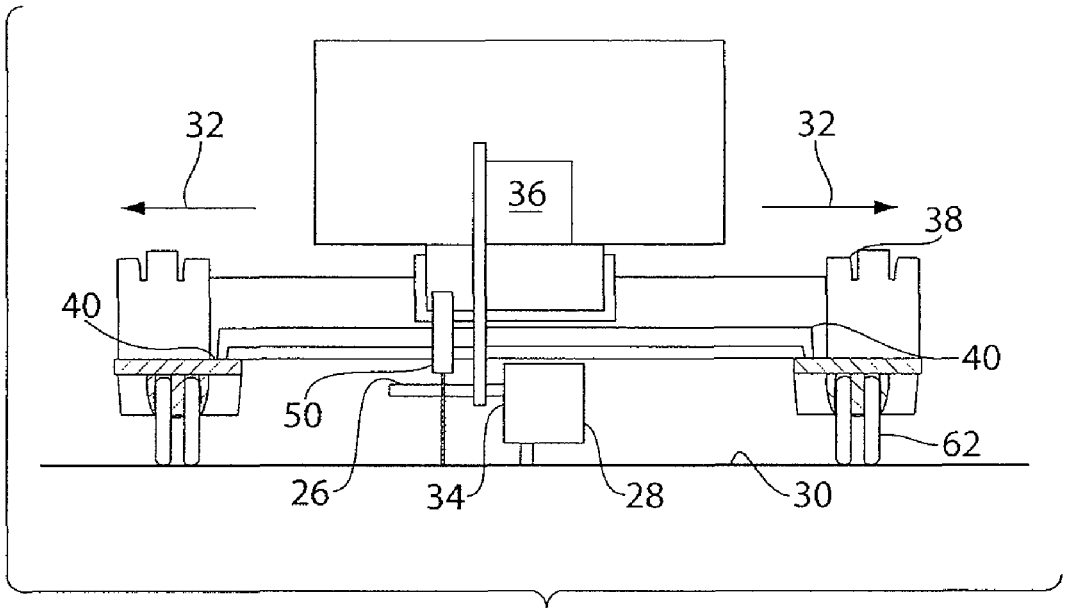
FIG. 2 is a close up view of the gantry of the embodiment shown in FIG. 1.

Turn now to the Figures, and initially FIG. 1, which shows a perspective view of a system, according to one embodiment. The system includes a movable frame 20 that extends for a length of about 50 feet, and that defines a first substantially straight horizontal axis 22. As shown in FIGS. 1 and 2, a gantry 24 that includes a tool platform 26 may travel along the first substantially straight horizontal axis to move a tool 28 along a pathway, typically either to cut or mark a playing surface 30. The gantry may also define a second substantially straight horizontal axis 32, transverse to the first horizontal axis, that the tool platform and tool may move along, either in preparation for altering the playing surface or while altering a playing surface. The tool platform includes a tool mount 34, as shown in FIG. 2, that may receive one of several different cutting and/or marking tools. The tool platform also includes an actuator 36 that moves the tool toward and/or away from the playing surface 30, as needed. The system includes a controller and actuators may automate the operation of the system according to an operating protocol, or as directed by an operator.

As shown in FIG. 1, the movable frame 20 is constructed to define a substantially straight horizontal axis 22 that a tool may follow so that the tool may, in turn, mark or cut the playing surface 30 along a substantially linear pathway. In the embodiment of FIG. 1, the linear axis is defined by a pair of rails 38 that each includes a bearing surface 40 for movably supporting a gantry. Cross bars 42, positioned at each end of the pair rails, may hold the rails relative to another in a parallel arrangement. Having two rails braced to one another may improve the overall straightness of the system, and may make the system stiffer, thus preventing any unwanted flexing. Additional braces 44, which extend above the rails to allow the passage of the gantry, may be incorporated into the frame to further stiffen the structure to help improve the straightness of the horizontal axis that the gantry 24 follows. It should be appreciated that the embodiment shown in FIG. 1 shows but one type of structure that may be used to define a substantially straight horizontal axis for a tool to follow, and that aspects of the invention are not limited to this structure. By way of example, according to other embodiments, the movable frame may include a single rigid rail, or even a tensioned cable that a tool may be configured to follow along substantially linear route.

Aluminum extrusions are used to form the rails in the illustrated embodiment. Extrusions generally have a high degree of straightness, and may prove beneficial for defining a substantially straight horizontal axis, particularly over longer lengths, such as 20 feet or greater, 30 feet or greater, 40 feet or greater, or even 50 feet or greater. Aluminum is also a relatively stiff material for its weight, which also may prove beneficial in maintaining a substantially straight axis, and for reducing the weight of the movable frame. According to one embodiment, aluminum extrusions purchased from www.robotunits.com may be used to create the rails and other components of the system. It is to be appreciated, however, that the movable frame may be manufactured from materials other than aluminum extrusions.

The movable frame may be configured to define axes of different lengths. According to the illustrated embodiment, the horizontal axis has a length of at least about 45 feet, which provides adequate distance to enable the tools controlled by the frame to cover a length of 39 feet, which corresponds to the distance from the net line to base line as defined by the rules of tennis. In this respect, a cut or mark that extends from the net line to the base line of a tennis court may be made by a single pass of a tool without having to reposition the movable frame. Configuring the movable frame to define a horizontal axis of at least 45 feet may also allow a tool to make any other cut or mark that lies on a common side of the net on a tennis court and that extends for 36 feet with a single pass of a tool and without repositioning the frame. The distance of 36 feet corresponds to the distance of the base line, as defined by the rules of tennis.

Embodiments of the system may also define a second horizontal axis or pathway that a tool may follow. By way of example FIG. 2 shows a close up view of the gantry 24 of FIG.

1, which allows the tool platform 26 to move along a second horizontal axis 32 that is transverse to the first horizontal axis. Providing a second horizontal axis may allow the tool to be repositioned to make multiple passes in directions parallel to the first horizontal axis, without having to relocate the frame. For example, a tool may first move from end to end of the frame, parallel to the first horizontal axis, to make a first cut or mark. The tool may then be moved along the second horizontal axis to make a second mark or cut that is also parallel to the first horizontal axis. This process may be repeated any number of times. This feature of the system may reduce the number of times that the frame is moved to make a complete set of marks or cuts on a playing surface, like a tennis court. The second horizontal axis may extend for different lengths, and in some embodiments, extends upward of 2 feet, 3 feet or more, 5 feet or more, or even 10 feet or more. If the second horizontal axis is made to be 45 feet or more, it would be possible to apply all of the lines, as dictated by the rules of tennis, and any corresponding sensors to one side of a tennis court without having to relocate the frame. In embodiments where the second horizontal axis is 85 feet or more, lines and grooves could be applied to an entire tennis court without having to relocate the frame.

The movable frame may include alignment features 46 to promote proper placement of the frame onto a playing surface 30. The alignment features, according to the illustrated embodiment, include lasers that are incorporated into the frame and that illuminate spots that lie along a pathway that is parallel to the first horizontal axis. The spots illuminated by the lasers may be positioned over known points on a playing surface, such as key positions or a chalk line, to help position the movable frame. Furthermore, having illumination spots positioned at various points along the length of the frame can help ensure that the frame is not bending or flexing to a degree that the affects the straightness of the horizontal axis. The embodiment shown in FIG. 1 includes five lasers incorporated into the frame, one at three of the braces that extend over the rails. Two additional lasers are positioned on temporary brackets 48 that extend between the rails 38 when the frame is positioned on the playing surface, but that are later removed when the playing surface is being altered. Embodiments of the frame may include additional and/or other types of alignment features, as it is to be appreciated that aspects of the invention are not limited to laser alignment tools.

The tool platform may also include alignment features. In one embodiment, as shown in FIG. 2, a laser 50 may be mounted to the tool platform 26 to illuminate a point that lies on the playing surface 30, and in one aspect may be used to confirm that the movable frame 20 is properly positioned on a playing surface 30. Here, the controller may instruct the tool platform to move to a position that places the illumination spot of the tool platform into alignment with one or more key positions or points along a chalk line on a playing surface. An operator may confirm that the illumination spot and key position/chalk line are in line with one another, and if not, move the frame until there is alignment, thus properly positioning the frame. An alignment tool mounted to the platform, in this manner, may be used in addition to or in place of alignment tools that are incorporated into the movable frame, as discussed herein.

In another aspect, the tool platform based laser may be used to calibrate the position of a tool that is installed onto the platform. Here, with the platform in an initial position, the tool may make an initial cut or mark on a playing surface. The platform may then be moved such that the illumination spot of the platform mounted laser is centered over the cut or mark, in a subsequent position. The distance that the platform moves, both along the first and second horizontal axes from the initial to subsequent positions may be measured to define an offset for the particular tool. It is to be appreciated that some tools may be incapable of making a small mark or cut in the playing surface, such a circular saws that will cut an relatively large arc. Here, the alignment tool may be positioned to identify the center of the relatively large mark or cut during the calibration procedure. The offset identified during calibration may be stored in a memory for that particular tool such that future calibrations are not required. It is, however, to be appreciated that periodic recalibrations may be desirable for some applications.

Having calibrations for each tool, as described above tools, may allow separate tools to alter the surface in a consistently overlapping pattern, or, equivalently, in patterns that are in registration with one another. By way of example, grooves to receive sensors may be cut with a first tool, such as a saw or router. A second tool, such as a taper or painter, may then replace the first tool, and be positioned to accurately mark a line or provide tape for a line with respect to the groove cut by the first tool, given that each of the first and second tools may be calibrated relative to the frame, and the playing surface. According to some approaches, the frame may be moved after making a first cut or mark on the playing surface, and then repositioned and aligned back over the first cut or mark, such that a second cut or mark may be made in registration with the first cut. According to other approaches, each of the first and second cuts or marks may be made without moving the frame, as aspects of the invention are not limited in this respect.

Figure 3:
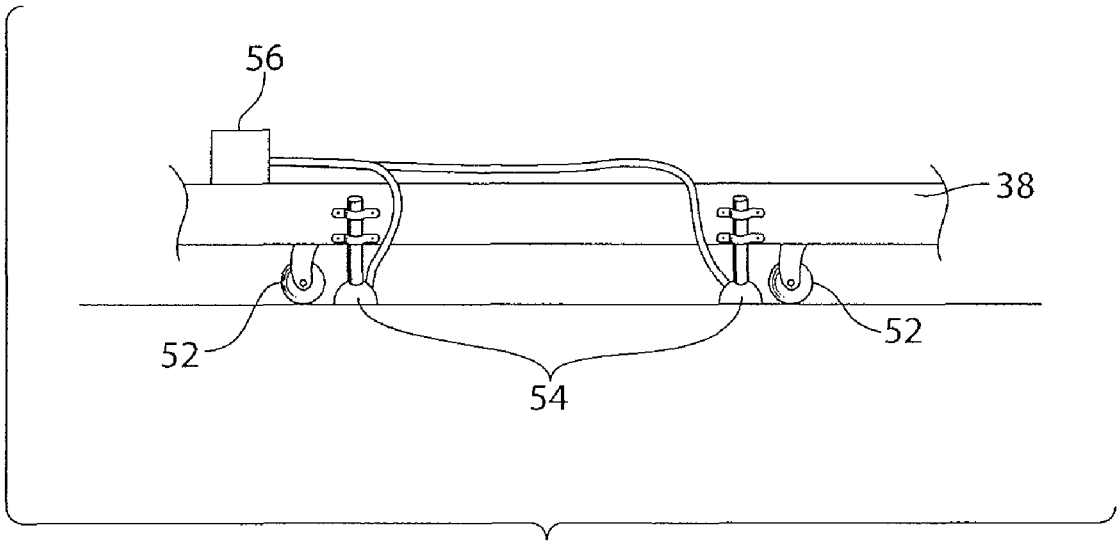
FIG. 3 is a close up view of rollers and vacuum cups, that may be used in embodiments of the movable frame.

The movable frame, as shown in FIG. 3, may include rollers 52 that allow the frame to be easily moved about a playing surface, or nudged into final position by an operator. Various types and numbers of rollers may be used. Rollers may be chosen with the maximum pressure that is to be applied against a playing surface by the system in mind so as to reduce likelihood of leaving imprints in the surface. Air filled tires, as shown in FIG. 3, have been found effective in this regard, particularly for tennis courts, although other types of rollers may also be used, such as nylon rollers, metallic rollers, and the like. Still, in other embodiments, low friction surfaces, such as nylon sheets, may be applied to the bottom of the frame instead of rollers, as rollers are not required.

The movable frame may be held in position by various different features. Rollers may include brakes that prevent the rollers, and thus the frame, from moving when the brakes are locked. In other embodiments, the rollers may be retracted so that the frame is lowered onto the playing surface, preventing further movement. According to one illustrative embodiment, suction cups 54 incorporated into the movable frame may be brought into contact with the playing surface to prevent unwanted movement. In some embodiments, an attached or free standing pneumatic pump 56 may be used to create a vacuum in the suction cups, either initially when the suction cups are moved into contact with the playing surface, or continually, to help maintain a vacuum as the playing surface is marked or cut. Intermittently or continuously drawing air from the suction cups with a pump may prove particularly beneficial when the playing surface is constructed of a porous material, like concrete or asphalt.

Embodiments of the frame may be assembled of smaller subcomponents to facilitate disassembly for transferring the system from one location to another. The rails shown in the Embodiment of FIG. 1 may be separated into approximately four equal lengths to facilitate placing the system into a truck. The joints in the rails may be reinforced with brackets to ensure proper alignment and a substantially straight orientation, when assembled together. Features such as lasers or alignment marks may assist an operator in properly reassembling the components. Additionally, electronics and other components of the system may disconnect to facilitate disassembling the system for travel. Embodiments of the movable frame may be disassembled into any number of subcomponents, or may even be manufactured as a unitary structure, as it is to be appreciated that there is no requirement for the movable frame to be capable of being disassembled in this manner.

Figure 4:
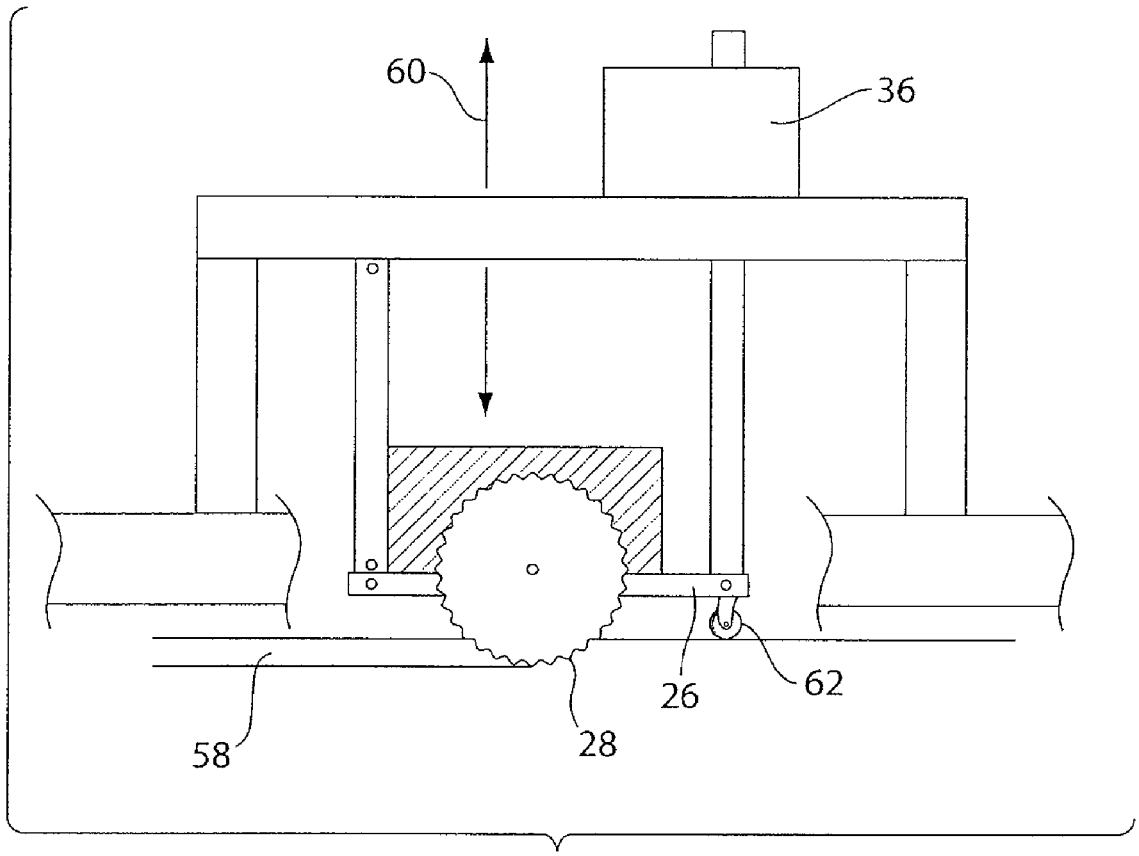
FIG. 4 is a view of a groove being cut into a playing surface, according to one embodiment.

Various tools, such as cutting and/or marking tools, may be attached to the tool platform, lowered into position above a playing surface, and actuated as they move along the first horizontal axis to alter the playing surface. According to some examples, cutting tools may include a circular saw, a drill, a polisher, a sander, a router, and the like. These cutting tools may prove particularly useful in cutting a groove 58 that is to receive a sensor, as shown in FIG. 4. Some examples of marking tools include a masking tool, such as might be used to mask a line for later painting; a painting tool, such as a paint fed roller or spray painter; a marker, and the like. Other types of tools may also be included, as the above listed tools are merely examples.

Tools attached to the mounting platform may be moved along a vertical axis 60 toward or away from the playing surface. In this respect, tools may be brought into engagement with and alter a playing surface for a distance that lies along a horizontal axis. The tools may then be moved away from and taken out of engagement with the playing surface to allow the tool to be repositioned along the horizontal axis before being re-engaged with the playing surface. According to some approaches, a tool may be engaged with a playing surface, disengaged from the playing surface, and then re-engaged with the playing surface multiple times, such that multiple, separate cuts or marks lie along a common pathway that lies parallel to the horizontal axis. Additionally or alternately, a tool may be moved along the second horizontal axis, and then engaged with the playing surface to provide multiple separate cuts or marks that extend parallel to the first horizontal axis, to one another, and that are separated from one another along the second horizontal axis.

Embodiments of the system may also include features to control the depth to which a cut is made into a playing surface, regardless of whether the surface has a flat or uneven topography. As shown in FIG. 4, the tool platform may include a roller 62 that follows the playing surface, and holds a cutting tool at a constant vertical position, relative to the top of the playing surface 30. According to one embodiment, grooves for receiving sensors are cut to a constant depth of about 1/32", as discussed in greater detail herein. It is to be appreciated, that grooves may be cut to other constant depths, and that grooves may be cut without any accommodation for changes in the topography of a playing surface, as aspects of the invention are not limited in this respect.

Motors or other types of actuators may be incorporated into the system to move the gantry 24 along the first horizontal axis 22 of the frame 20, to move the tool platform 26 along the second horizontal axis 32 of the gantry, and/or to move the tool 28 vertically toward or away from the playing surface 30. Additionally, sensors may be incorporated into the system to identify the position of the tool along any of the first and second horizontal axes, and/or the vertical axis.

The system may also include a controller that receives information from an operating protocol and any other sensors in the system to, in turn, control the tool platform and tool to mark and/or cut a playing surface according to a predetermined plan. The controller and operating protocol combination may be implemented in any of numerous ways. For example, in one embodiment the controller and treatment protocol combination may be implemented using hardware, software or a combination thereof. When implemented in software, the software code can be executed on any suitable processor or collection of processors, whether provided in a single computer or distributed among multiple computers. It should be appreciated that any component or collection of components that perform the functions described herein can be generically considered as one or more controllers that control the functions discussed herein. The one or more controllers can be implemented in numerous ways, such as with dedicated hardware, or with general purpose hardware (e.g., one or more processors) that is programmed using microcode or software to perform the functions recited above. The one or more controllers may be included in one or more host computers, one or more storage systems, or any other type of computer that may include one or more storage devices coupled to the one or more controllers. In one embodiment, the controller includes a communication link to communicate wirelessly, or via electrical or optical cable, to a remote location.

In this respect, it should be appreciated that one implementation of the embodiments of the present invention comprises at least one computer-readable medium (e.g., a computer memory, a floppy disk, a compact disk, a tape, etc.) encoded with an operating protocol in the form of a computer program (i.e., a plurality of instructions), which, when executed by the controller, performs the herein-discussed functions of the embodiments of the present invention. The computer-readable medium can be transportable such that the operating protocol stored thereon can be loaded onto any computer system resource to implement the aspects of the present invention discussed herein. In addition, it should be appreciated that the reference to an operating protocol or controller which, when executed, performs the herein-discussed functions, is not limited to an application program running on a host computer. Rather, the term operating protocol is used herein in a generic sense to reference any type of computer code (e.g., software or microcode) that can be employed to program a processor to implement the herein-discussed aspects of the present invention.

Another aspect of the invention relates to methods and apparatus that may be used to more accurately define locations at which lines are to be placed on a playing surface. One illustrative embodiment, relating to a tennis court, is described herein although it is to be appreciated that the same principals may be applicable to defining locations for lines on other types of playing surfaces. In addition, the apparatus may define key positions to control the placement of a movable frame, as described herein, for cutting grooves or otherwise altering a playing surface. Alignment of the movable frame with such key positions may allow both grooves for sensors and masking tape for defining lines of a playing surface to be placed precisely, with respect to one another.

Figure 5:
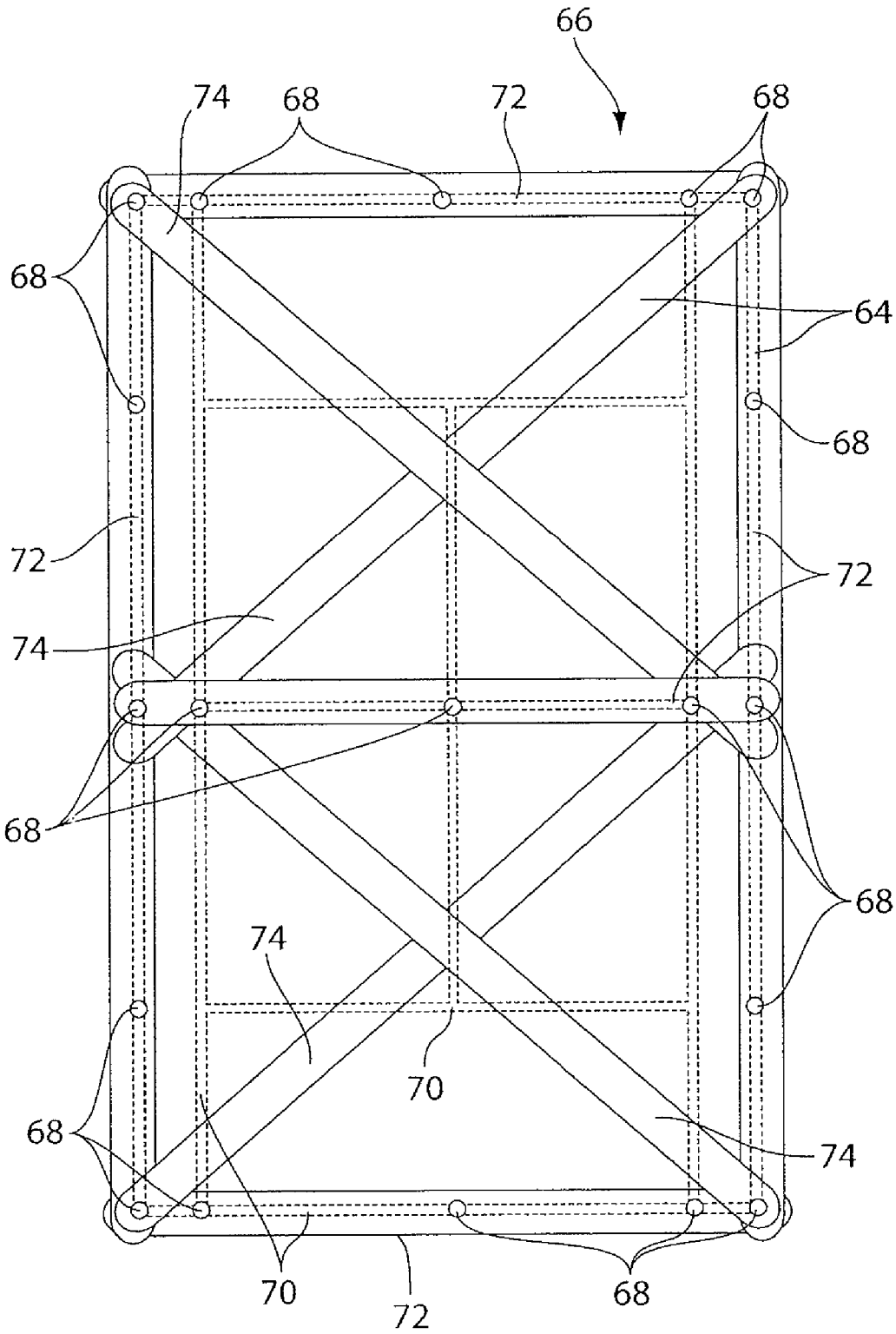
FIG. 5 is a plan view of a tennis court and a template that may be used to define key positions on the tennis court, according to one embodiment.

As shown in FIG. 5, multiple strips 64 of material are connected together to define a template 66 that accurately identifies key positions on the playing surface. Anchors or other identifiers may be placed at the key positions 68 defined by the template, when the template is in place on the playing surface 30. The key positions may, in turn, be used to define lines 70 on the playing surface, such as after the template is removed.

According to one embodiment, nineteen key positions are defined by a template, as shown in FIG. 5. Sixteen key positions are defined by the intersections of the base lines and the doubles side lines (four points); intersections of the base lines and the singles side lines (four points); intersections of the base lines and an extension of the center service line (two points); intersections of the net line and the doubles side lines (two points); intersections of the doubles side lines and extensions of the service lines (four points). Additional key positions may be included at the center of the net line (one point) and at the intersection of the singles side lines and net line (two points). It is to be appreciated that key positions that lie along the doubles side lines may alternately be positioned along the singles side lines.

Subsequent to identifying the key positions, embodiments of the movable frame described herein may be used to mark lines on the playing surface. Alternately, conventional techniques, may be used to mark lines on a playing surface between some or all of the key positions.

In the embodiment of FIG. 5, the template is made of nine different strips. A first set of five position strips 72 lie along the key positions and include one strip lying along the net line, a strip lying along each of the two base lines, and a strip lying along each of the two doubles side lines (or alternately, along the singles side lines). Additionally, a second set of four diagonal strips 74 are connected to the position strips at various points to insure a proper orientation between each of the position defining strips, and thus the key positions. The diagonal strips connect key positions at the intersection of the doubles side line and base line to key positions at the intersection of the net line and the opposed doubles side line, although other configurations are possible.

According to some approaches, the diagonal strips 74 are configured to define a length that corresponds to a distance between key positions that lie diagonal from one another on opposed sides of a playing surface. Here, the length of the diagonal strip may be determined by calculating, through Pythagorean's theorem, the hypotenuse that corresponds to the distances between the key positions along the position strips 72.

Figure 6:
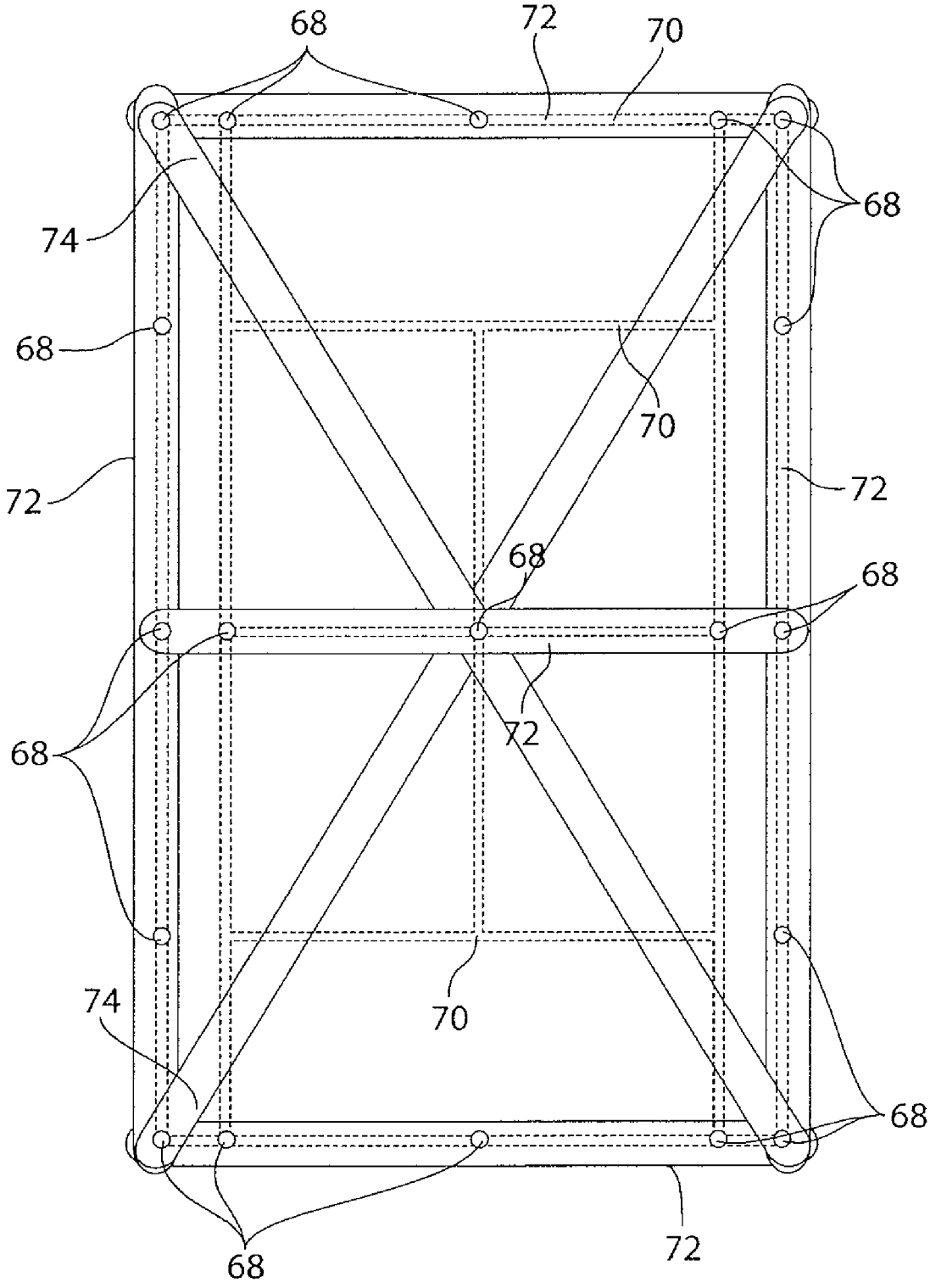
FIG. 6 is a plan view of a tennis court and a template that may be used to define key positions on the tennis court, according to another embodiment.

According to another embodiment, as shown in FIG. 6, the set of diagonal strips 74 includes only two strips that each connect diametrically opposed key positions 68 at the intersections of the base lines and doubles side lines. Still other arrangements are possible, such as embodiments that include only a single diagonal strip. It is also to be appreciated that the diagonal strips may connect to the position strips at points other than the key positions, as aspects of the invention are not limited in this regard.

Figure 7:
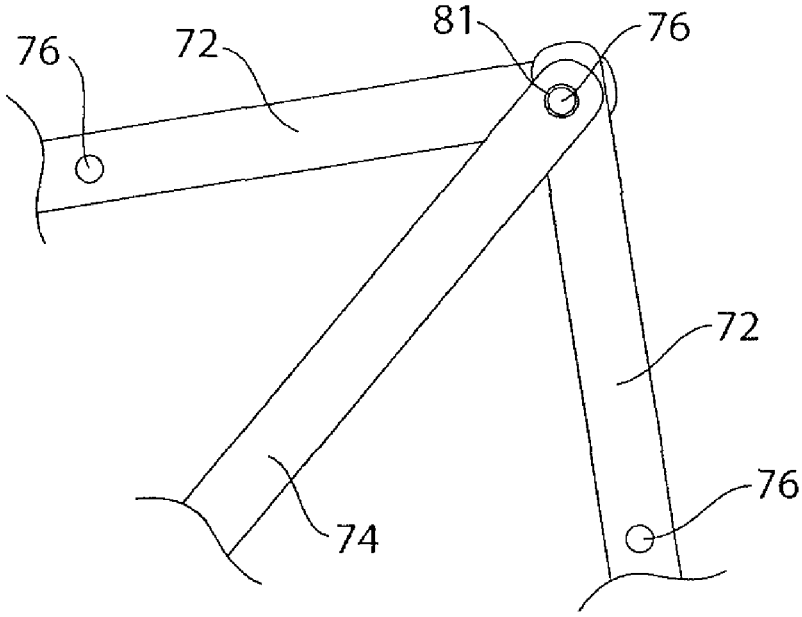
FIG. 7 is a view of a strip of material that may be used to form a template, according to one embodiment.
Figure 8:
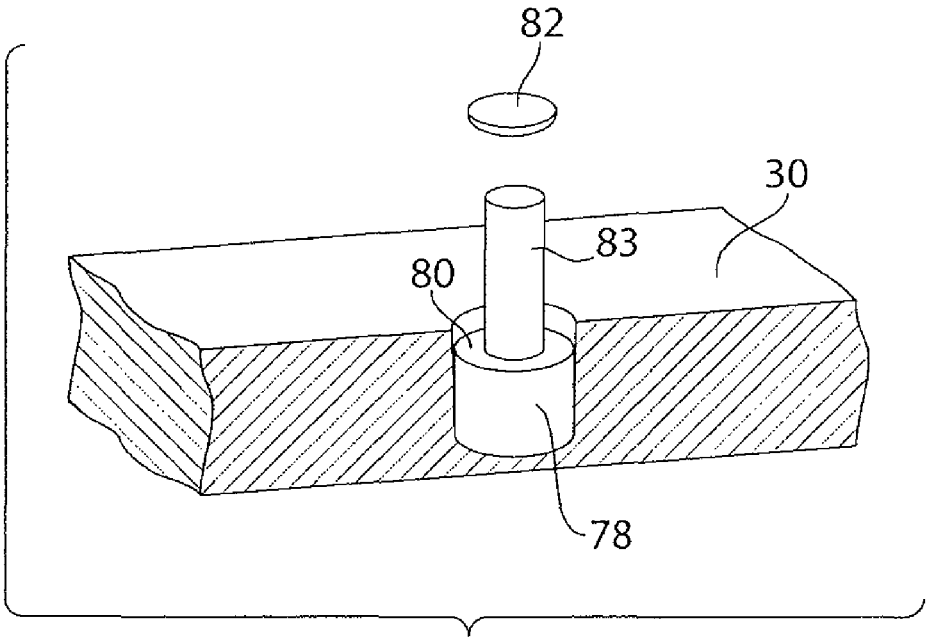
FIG. 8 is a view of a ferule, a pin, and a cap that may be used as an anchor, according to one embodiment.

Key position strips may include apertures 76, as shown in FIG. 7, for defining the locations at which key positions 68 are to be marked or anchors 78 as shown in FIG. 8 are to be placed. Such apertures 76 may help to further promote proper placement of key positions. The strips may only include apertures that correspond to key positions, and in this respect, confusion may be minimized as to where marks or anchors should be placed. The key positions, as defined by the template, may lie in a center portion of a line that is to eventually be marked on the playing surface, given that lines on a tennis court are usually 2" in width, although other configurations are possible.

Strips 64 may be connected together by various features to define a template. According to some embodiments, eyelets 81 may hold strips to another, as shown in FIG. 7. The eyelets 81 may allow the strips to pivot relative to one another to prevent the strips from binding or twisting when being positioned about the playing surface. The eyelets may also provide an aperture through which a playing surface may be marked or an anchor may be positioned. The eyelets may be permanently hold the strips together, or may be removable. Those of skill in the art will appreciate that other types of fasteners may also be used to join strips together, as aspects of the invention are not limited to cylindrical pins.

Different types of material may be used to form the key position strips and/or diagonal strips of material that form the template. Such materials may include metal or somewhat rigid fabric, like that used to form measuring tapes. The material may also be readily folded or rolled to allow individual strips or an entire template to be easily stored when not in use.

According to one approach, the template is formed by first placing a 36 foot or longer key position strip along the net line of the playing surface. This strip is pulled taught. Next a key position strip that defines a doubles side line is positioned and attached to the first strip (if not previously or permanently attached), and is then oriented and pulled taught. Key position strips that lie over the other doubles side line and base lines are then laid in place, attached to the corresponding key position strips (if not already attached) and are also pulled taught. Diagonal strips are attached to appropriate points of the key position strips.

Various types of anchors 78 and/or marks may be used in combination with the template to identify key positions. According to some embodiments, nails or pegs are hammered into the playing surface, through apertures in the tape. The nails or pegs may remain in place until the court is marked, such as with chalk lines. The nails may then be removed while more permanent lines are applied to the playing surface. According to some embodiments, the nail or other type of anchor is sized to have a diameter that matches the aperture or eyelet in the strip, and in this regard, movement of the template relative to the anchor may be minimized. According to other embodiments, non-contact type anchors may be placed into the playing surface, such as magnets or RFID tags that may be detected by a reader that is positioned on top of the playing surface. Alternately or additionally, key positions may be directly marked through the apertures in the template, such as with permanent markers, paint, and the like.

According to some approaches, permanent anchors are placed at key positions with the assistance of the template. In one approach, a ferrule 78, as shown in FIG. 8, is permanently inserted into the playing surface. The ferrule may be recessed relative to the playing surface 30 so as not to interfere with play, and may accept a pin 83 that may, in turn, be inserted into the aperture of a template. In some embodiments, the pin may be removed and the ferrule may be capped 82 and covered as the playing surface is painted or otherwise coated. The ferrule(s) that identify key positions may later be uncovered and used to reline the playing surface, or simply to confirm the positions of existing lines on the playing surface.

Embodiments of the template, as described herein, may be used to directly identify the boundaries of a playing surface (i.e., the outermost edge of lines that mark a tennis court), or points that are offset from the boundaries by a common distance. By way of example, a template may identify key positions that lie centrally along lines of a tennis court that are two inches wide. Here, the boundary of the tennis court will actually be offset by half the width of the lines, which in this instance is one inch.

Other aspects of the invention relate to patterns of impact detecting sensors that may be placed into a tennis court to determine whether a ball has landed in either of the service courts and/or in or out of play, on either side of the net. According to a first embodiment, the sensors are placed in a pattern optimized for play that is supervised by a referee. According to a second embodiment, the sensors are placed in a pattern that is optimized for comprehensive coverage, such as might be particularly useful for unsupervised play.

The patterns may include grooves that are cut into a playing surface, and that receive the sensors. The grooves may then be covered with filling material, such as silicone rubber, prior to normal surface coatings like paint being applied to the playing surface. In other embodiments, sensors may be incorporated into the playing surface, in the illustrated patterns, without being positioned in grooves. Still, in other embodiments, the sensors may be positioned on top of the playing surface, as aspects of the invention are not limited in this respect.

Figure 9:
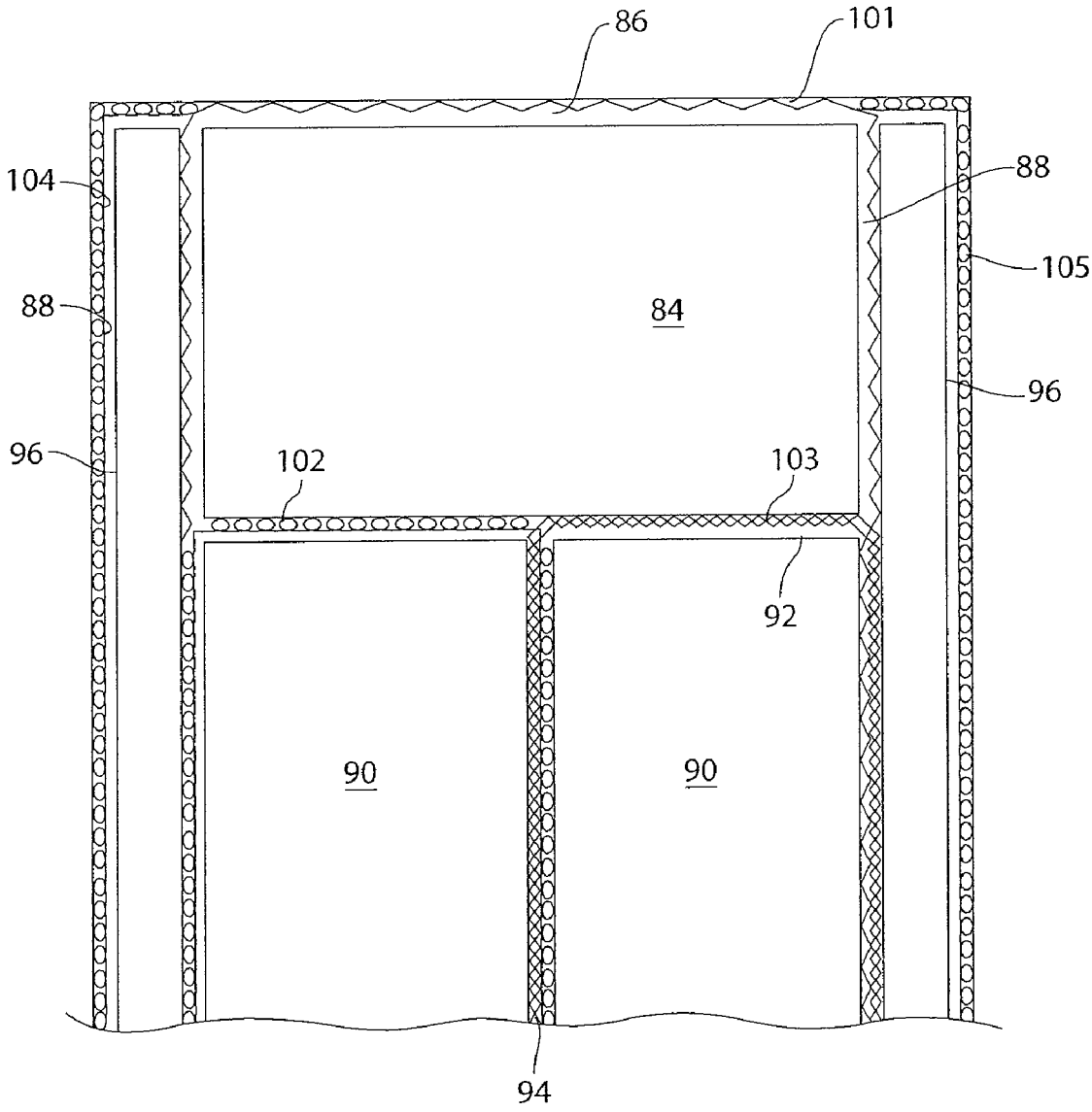
FIG. 9 is a plan view of a pattern of sensor circuits superimposed on one half of a tennis court, according to one embodiment.

A pattern optimized for supervised play, either singles or doubles play, is shown in FIG. 9. It is to be appreciated that only one side of a tennis court is shown, and that each of the sensor circuits shown in FIG. 9 may continue onto the opposite side of the court in a mirrored pattern. This pattern comprises a first impact detecting sensor circuit 101 positioned about the backcourt 84, including portions of the baseline 86 that are used in singles play and portions of the singles side lines 88 that lie about the backcourt. A second and third circuit, 102, 103 are each positioned about each service court 90, respectively, including corresponding portions of the service line 92, singles side lines 88, and center service line 94. Fourth and fifth circuits 104, 105 include the doubles side lines 96 and portions of the baseline that are used only in doubles play.

For the pattern shown in FIG. 9, sensors are typically positioned under the lines of the court and extend to both sides of the net. Sensors, configured in this manner, may be used to indicate when a ball has impacted the line and thus should be determined to have landed "in" a corresponding region.

Figure 10:
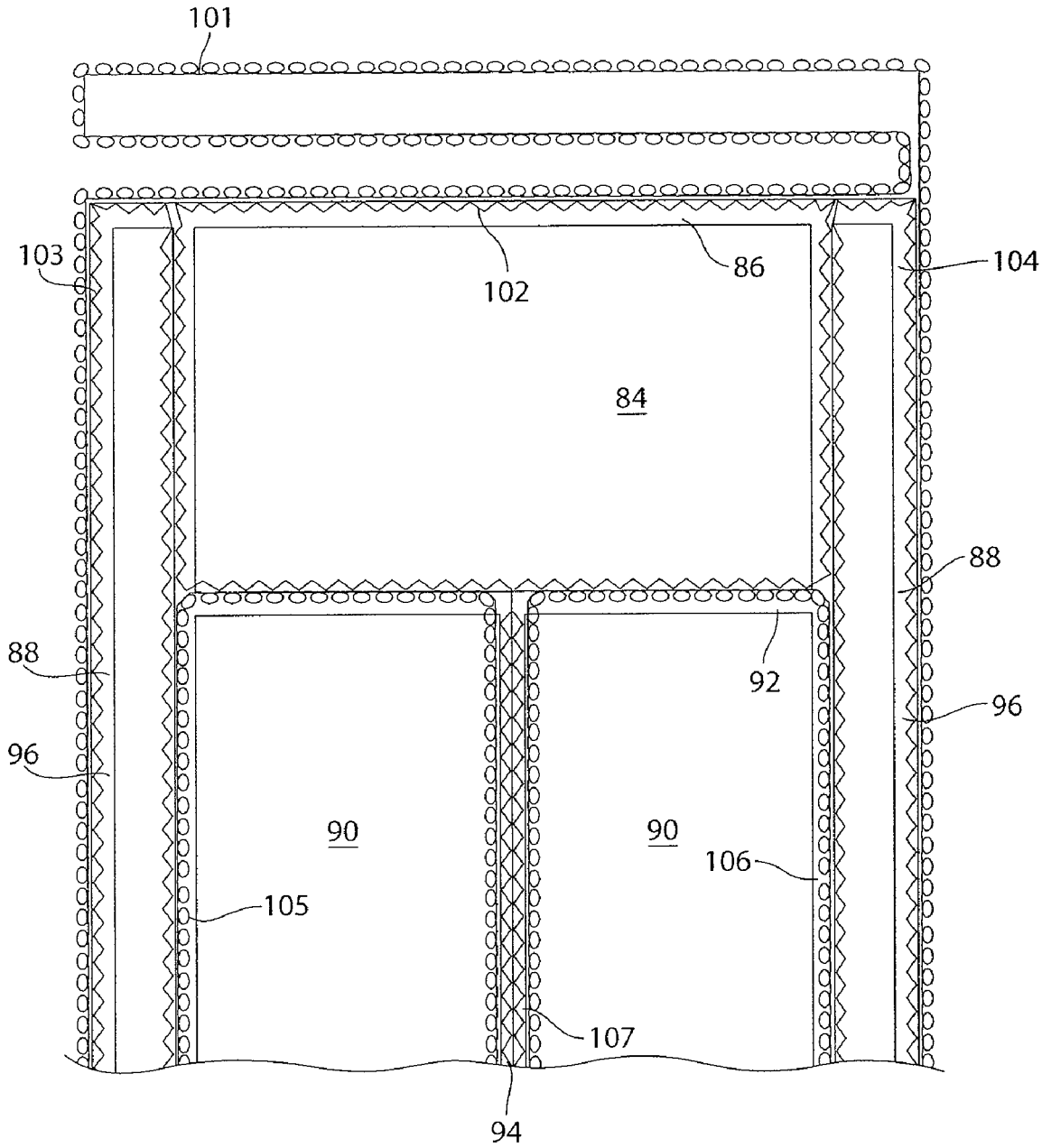
FIG. 10 is a plan view of a pattern of sensor circuits superimposed on one half of a tennis court, according to another embodiment.

FIG. 10 shows a pattern that may be used for comprehensive coverage of a tennis court, such as might be desirable during unsupervised plan. It is to be appreciated that FIG. 10 shows but one side of a tennis court, and that a separate, but similar pattern of sensor circuits may be applied to the opposite side of the court. In this pattern, balls that land near a boundary line will impact one of two different regions that lie on either side of the boundary line or on the boundary line (i.e., the outermost edge of a line that defines a particular region of a court). In this respect, one of the two sensors will positively identify the place at which the ball has landed, such that a determination may be made as to whether the ball landed in play or out of play.

The pattern shown in FIG. 10 includes a first circuit 101 that lies on the outer side of the base line 86 and doubles side lines 96. A second circuit 102 lies on the inner side of the backcourt 84 including the baseline and beyond the service lines, 92. Third and fourth circuits 103, 104 lie in the areas inside of the singles side lines 88, on the doubles side lines 96, and portions of the baseline 86 that are reserved for doubles play. Fifth and sixth circuits 105, 106 lie about the inner portions of each service court 90, respectively, except along the center service line 94, where sensor of the fifth and sixth 105, 106 circuits jog inwardly of the corresponding service court. Additionally, a seventh circuit 107 lies directly under both sides of the center service line 94, and may be used in combination with the fifth and sixth circuits 105, 106 to determine the position of balls that land near the center service line 94. The seventh circuit 107 may prove beneficial, given that the center service line, depending on the status of play, may be consider "in" for each of the service courts.

Sensors arranged in patterns may be connected to a controller that includes logic to identify to a player or referee when a ball lands in play, or out of play. The controller may accept other inputs, such as whether the players are engaged in singles play or doubles play, and may adjust the logic accordingly to reflect rules of the game being played. Additionally or alternately, the controller may accept inputs that relate to the status of play, such as who is serving, who has an advantage, and the like. According to some embodiments, this information may be input continually by a referee or other supervisor. In other embodiments, the information my be input by players when they approach the controller, such as after a dispute arises as to whether a ball was in play or out of play.

Rules of precedent between various sensor circuits may also be incorporated into the controller. By way of example, in the embodiment of FIG. 10, a precedent may be set such that the seventh circuit sensor will take precedent if both the seventh circuit and fifth or sixth circuits are impacted simultaneously or in near succession to one another. The precedents are well defined by the rules of tennis.

Individual sensors in any given circuit may be extended to result in additional coverage, like the first circuit near the base line, as shown in FIG. 10 where a groove and corresponding sensors is arranged to run parallel to itself at positions outside of the baseline. In this respect, the area in which a ball may be detected can be extended to points further from a boundary.

In each of the patterns shown in FIGS. 9 and 10, the overlap between sensors of different circuits is minimized. In this respect, interference between the various different circuits may be minimized or altogether eliminated.

Embodiments of sensor circuit patterns may incorporate various types of sensors. In some embodiments, triboelectric sensors are used, like those described in U.S. Pat. No. 5,908,361 to Fisher, which is hereby incorporated by reference in its entirety. In other embodiments, pressure sensitive switches, piezoelectric sensors, color changing sensors, and the like, may be used, as aspects of the invention are not limited to any one type of sensor.

Grooves to receive sensors in the patterns shown in each of FIGS. 9 and 10 may be formed through various techniques. According to one approach, a system like that shown in FIG. 1 is used to cut grooves/sensor circuits shown in FIG. 10. Here, the movable frame may be positioned a total of 14 times to cut pathways for all of the sensor circuits. The movable frame may be positioned along the net line to make a set of grooves that provide pathways for the sensors to travel from the court and to a controller, which typically resides off of the playing surface.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the description and drawings herein are by way of example only.

The invention claimed is:

1. A system in combination with a playing surface of a tennis court, the system comprising:

a movable frame that extends for a distance of 3 feet or more to define a first substantially straight horizontal axis;

a plurality of tools for modifying the playing surface; and a tool platform configured to move along the first horizontal axis, the tool platform providing a mounting feature for the plurality of tools that may be used to modify the playing surface, a first of the plurality of tools being a cutting tool mountable to the tool platform and configured to make a cut in the playing surface of the tennis court and a second of the plurality of tools being a marking tool mountable to the tool platform and configured to make a mark that remains for use on the playing surface of the tennis court that is in registration with the cut in the playing surface of the tennis court.

2. The system of claim 1, wherein the movable frame extends for a distance of 20 feet or more to define the first substantially horizontal axis.

3. The system of claim 1, wherein the movable frame extends for a distance of 50 feet or more to define the first substantially horizontal axis.

4. The system of claim 1, wherein the movable frame is constructed of multiple frame segments that may be disassembled from one another.

5. The system of claim 1, further comprising:

a gantry on which the tool platform is mounted, the gantry defining a second substantially straight horizontal axis, transverse to the first horizontal axis, the tool platform being configured to move along the second horizontal axis.

6. The system of claim 5, wherein the tool platform defines a third axis along which the one or more tools may be moved in a vertical direction.

7. The system of claim 1, wherein the tool platform includes a follower that identifies the playing surface and provides a constant vertical offset from the playing surface for the plurality of tools.

8. The system of claim 1, wherein the plurality of tools are selected from a group consisting of: a circular saw, a router, a taper, a liner, a marker, a drill, a cutter, a sander, a polisher, and a painter.

9. The system of claim 1, further comprising:

rollers mounted to the movable frame.

10. The system of claim 9, further comprising:

locking features to temporarily locate the movable frame to a surface to be modified.

11. The system of claim 10, wherein the locking features include suction cups.

12. The system of claim 1, further comprising:

an alignment tool.

13. The system of claim 12, wherein the alignment tool is mounted to the tool platform.

14. The system of claim 12, wherein the alignment tool comprises a plurality of alignment tools mounted to the movable frame.

15. The system of claim 1, further comprising:

a controller configured to control movement of the tool about the first horizontal axis, a second horizontal axis that is transverse to the first horizontal axis, and a third axis that extends in a vertical direction.

16. The pattern of claim 15, wherein the controller is programmable to move the cutting tool and the marking tool so as to make the mark on the playing surface that is in registration with the cut in the playing surface.

* * * * *